US008374371B2

(12) United States Patent
Miles

(10) Patent No.: US 8,374,371 B2
(45) Date of Patent: Feb. 12, 2013

(54) MINIATURE NON-DIRECTIONAL MICROPHONE

(75) Inventor: Ronald N. Miles, Newark Valley, NY (US)

(73) Assignee: The Research Foundation of State University of New York, Binghamton, NY (US)

( * ) Notice: Subject to any disclaimer, the term of this patent is extended or adjusted under 35 U.S.C. 154(b) by 167 days.

(21) Appl. No.: 13/039,994

(22) Filed: Mar. 3, 2011

(65) Prior Publication Data

US 2011/0150260 A1 Jun. 23, 2011

Related U.S. Application Data

(62) Division of application No. 11/550,702, filed on Oct. 18, 2006, now Pat. No. 7,903,835.

(51) Int. Cl.
*H04R 25/00* (2006.01)

(52) U.S. Cl. ..... 381/355; 381/369

(58) Field of Classification Search ..... 381/172, 381/174–176, 357–358, 181, 429; 367/174, 367/181

See application file for complete search history.

(56) References Cited

U.S. PATENT DOCUMENTS

| | | | | |
|---|---|---|---|---|
| 6,088,463 | A * | 7/2000 | Rombach et al. | 381/174 |
| 7,103,196 | B2 * | 9/2006 | Warren | 381/429 |
| 7,146,016 | B2 * | 12/2006 | Pedersen | 381/175 |
| 7,171,012 | B2 * | 1/2007 | Izuchi et al. | 381/174 |
| 2002/0164043 | A1 * | 11/2002 | Paritsky et al. | 381/356 |
| 2006/0280319 | A1 * | 12/2006 | Wang et al. | 381/172 |

* cited by examiner

*Primary Examiner* — Suhan Ni
(74) *Attorney, Agent, or Firm* — Steven M. Hoffberg; Ostrolenk Faber LLP

(57) ABSTRACT

A miniature microphone comprising a diaphragm compliantly suspended over an enclosed air volume having a vent port is provided, wherein an effective stiffness of the diaphragm with respect to displacement by acoustic vibrations is controlled principally by the enclosed air volume and the port. The microphone may be formed using silicon microfabrication techniques and has sensitivity to sound pressure substantially unrelated to the size of the diaphragm over a broad range of realistic sizes. The diaphragm is rotatively suspend for movement through an arc in response to acoustic vibrations, for example by beams or tabs, and has a surrounding perimeter slit separating the diaphragm from its support structure. The air volume behind the diaphragm provides a restoring spring force for the diaphragm. The microphone's sensitivity is related to the air volume, perimeter slit, and stiffness of the diaphragm and its mechanical supports, and not the area of the diaphragm.

20 Claims, 6 Drawing Sheets

MINIATURE NON-DIRECTIONAL MICROPHONE

RELATED APPLICATIONS

The present application is a Division of U.S. patent application Ser. No. 11/550,702, for MINIATURE NON-DIRECTIONAL MICROPHONE, filed Oct. 18, 2006, expressly incorporated herein by reference. The present invention is related to co-pending U.S. patent application Ser. Nos. 10/689,189, for ROBUST DIAPHRAGM FOR AN ACOUSTIC DEVICE, filed Oct. 20, 2003, 11/198,370 for COMB SENSE MICROPHONE, filed Aug. 5, 2005, 11/335,137 for OPTICAL SENSING IN A DIRECTIONAL MEMS MICROPHONE, filed Jan. 19, 2006, and 11/343,564 for SURFACE MICROMACHINED MICROPHONE, filed Jan. 31, 2006, all of which are included herein in their entirety by reference.

FUNDED RESEARCH

This invention was made with government support under Award R01DC005762 awarded by the National Institute of Health. The government has certain rights in the invention.

FIELD OF THE INVENTION

The present invention relates to the field of miniature non-directional microphones, particular, to miniature microphones having high sensitivity and good low frequency response characteristics.

BACKGROUND OF THE INVENTION

Small microphones that can be manufactured with low cost are highly desirable components in many portable electronic products. In current design approaches, however, the small size of the microphone results in diminished sensitivity to sound, and in particular poor sensitivity to low frequencies. As a result, great care must be taken in the design to maximize sensitivity, which generally adds to the complexity and cost of the device.

The conventional approach to creating small microphones is to fabricate a thin, lightweight diaphragm that vibrates in response to minute sound pressures. The motion of the diaphragm is usually transduced into an electronic signal through capacitive sensing, where changes in capacitance are detected between the moving diaphragm and a fixed backplate electrode. As the size of the diaphragm is reduced, however, in an attempt to make a small, low-cost microphone, the stiffness of the diaphragm is generally increased. This increased stiffness causes a marked reduction in its ability to deflect in response to fluctuating sound pressures. This increased stiffness with decreasing size is a fundamental challenge in the design of small microphones. An additional challenge in the design of microphones comes from the use of a backplate electrode to achieve capacitive sensing. To obtain an electronic readout, it is necessary to apply a biasing electric voltage between the backplate and the diaphragm. This will result in a force that is proportional to the square of the voltage (and hence is independent of its polarity) that always acts to attract the flexible diaphragm toward the fixed backplate. Because the output of the electronic circuit will be proportional to the biasing voltage used, one is tempted to use as high a voltage as possible to increase sensitivity. However, great care must be taken to ensure that the resulting attractive force is not sufficient to collapse the diaphragm into the backplate. To avoid this potentially catastrophic situation, one may use a diaphragm that has a higher stiffness so it can resist the attractive force, but this also results in reduced acoustic sensitivity. Achieving a compromise between increased electronic sensitivity through the use of a high bias voltage and avoiding diaphragm collapse is one of the most challenging aspects of microphone design.

Because microphones are generally designed to respond to sound pressures using a pressure-sensitive diaphragm, it is important to ensure that the pressure due to sound acts on only one side, or face of the diaphragm otherwise the pressures acting on the two sides will cancel. (In some cases, this cancellation property is used to advantage, especially where the microphone can be designed such that undesired sounds are cancelled while desired sounds are not). In addition, because the diaphragm is also subjected to relatively large atmospheric pressure changes, it is important to incorporate a small vent to equalize static pressures on the two sides of the diaphragm. Depending on the size of the enclosure around the back-side of the diaphragm and the size of the pressure-equalizing vent, the low-frequency response of the diaphragm will also be reduced by the vent. In small microphones, the air volume behind the diaphragm is generally quite small and as a result, motion of the diaphragm can cause a significant change in the volume of the air. The air thus becomes compressed or expanded as the diaphragm moves, which results in a respective increase or decrease in its pressure. This pressure creates a restoring force on the diaphragm and could be viewed as an equivalent linear air spring having a stiffness that increases as the nominal volume of air is reduced. The combined effects of the diaphragm's mechanical stiffness, the pressure-equalizing vent, and the equivalent air spring of the back volume need to be considered very carefully in designing microphones that are small, have good sensitivity and respond at low audio frequencies When a microphone is sensing small differences in the air pressure (i.e., sound waves), both large and small diaphragms will, in principle, be equally capable of picking up low frequencies. The lower limiting frequency (LLF) of a pressure microphone is typically controlled by a small pressure equalization vent that prevents the microphone diaphragm from responding to changes in the ambient barometric pressure. The vent typically acts as an acoustic low cut filter (i.e., a high-pass filter) whose cut-off frequency depends on the vent dimensions (e.g., diameter and length). As a sound pressure wave passes the microphone, longer wavelengths (lower frequencies) will tend to equalize pressure around the diaphragm and thus cancel their response.

SUMMARY OF THE INVENTION

In accordance with the present invention, there is provided a miniature, generally non-directional microphone that maintains both good sensitivity and low-frequency response as the surface area of the microphone's diaphragm is reduced. A preferred implementation of the microphone provides a silicon diaphragm formed using silicon microfabrication techniques and has sensitivity to sound pressure substantially unrelated to the size (e.g., sensing area) of the diaphragm.

In the preferred embodiment, the diaphragm is rotatively suspended by two stiff beams and has a surrounding perimeter slit separating the diaphragm from its support structure. Air in a back volume behind the diaphragm provides a restoring spring force for the diaphragm. The relationship of the volume of air in the back volume, the perimeter slit characteristics, and the effective stiffness of the diaphragm (generally determined by the stiffness of the beams supporting the diaphragm for rotational displacement in response to acoustic waves) determine the microphone's sensitivity.

In accordance with a preferred embodiment, the present invention provides a tiny microphone diaphragm that is dramatically less stiff than what can be achieved with previous approaches. Therefore, the responsivity is increased.

A preferred embodiment in accordance with the present invention avoids imposing a large force between the diaphragm and the backplate due to a sensing voltage, and employs a different transduction approach, which does not require mechanical stiffness of the out-of-plane motion of the diaphragm to avoid collapse. Preferably, a significant electrostatic force component from the sensing voltage is disposed in the plane of the diaphragm, and thus has a lower tendency to displace the diaphragm.

The permitted use of a highly flexible diaphragm in accordance with preferred embodiments of the present invention causes the overall sensitivity to be less dependent on the diaphragm's stiffness and the size of the vent than that of prior approaches.

The microphone according to the present invention preferably has a sensing membrane displacement which is approximately (within, e.g., 5%) proportional to the pressure and volume of a back space, and inversely proportional to an area of a slit which viscously equalizes the pressure of the back space with the environment, e.g., PV/A, and, for example, providing a ±3 dB amplitude response over at least one octave, and preferably ±6 dB amplitude response over a range of 6 octaves, e.g., 100 to 3200 Hz. Of course, the microphone may have far better performance, e.g., ±3 dB amplitude response from 50 to 10 kHz, and/or a displacement which is proportional to PV/A within 1% or better. It is noted that the electrical performance of the transducer may differ from the mechanical performance, and indeed electronic techniques are available for correcting mechanical deficiencies, separate from the performance criteria discussed above. Likewise, the electrical components may be a limiting or controlling factor in the accuracy of the output.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

The motion of a diaphragm of a typical microphone results in a fluctuation in the net volume (at standardized temperature and pressure) of air in a region behind the diaphragm. The compression and expansion of the air in this region due to the diaphragm's motion results in a linear restoring force that effectively stiffens the diaphragm and reduces its response to sound. This stiffness acts in parallel with the mechanical stiffness of the diaphragm, which, in small microphones and particularly in silicon microphones, is normally much greater than the stiffness of the air in the back volume.

The present invention permits a diaphragm to be designed such that its mechanical stiffness is much less than that resulting from the compression of air or fluid in the back volume, even though the diaphragm is fabricated out of a very stiff material such as silicon.

Unlike typical microphone diaphragms that are supported around their entire perimeter, the diaphragm according to a preferred embodiment of the present invention is supported only by flexible pivots around a small portion of its perimeter, and is separated from the surrounding substrate by a narrow slit around the remainder of its perimeter. U.S. patent application Ser. No. 10/689,189, expressly incorporated herein by reference, describes a microphone diaphragm that is supported on flexible pivots. The pivots may be designed to have nearly any desired stiffness. Because the area of silicon is reduced, its corresponding contribution to the effective stiffness of the diaphragm, representing the extent of its movement in response to acoustic pressure waves of various amplitudes, is reduced. Therefore, the back-volume effective stiffness, which roughly corresponds to $\Delta p = nRT/\Delta V$ (ideal gas law equation), and the contribution from the slit, will control the effective stiffness.

Figure 1A:
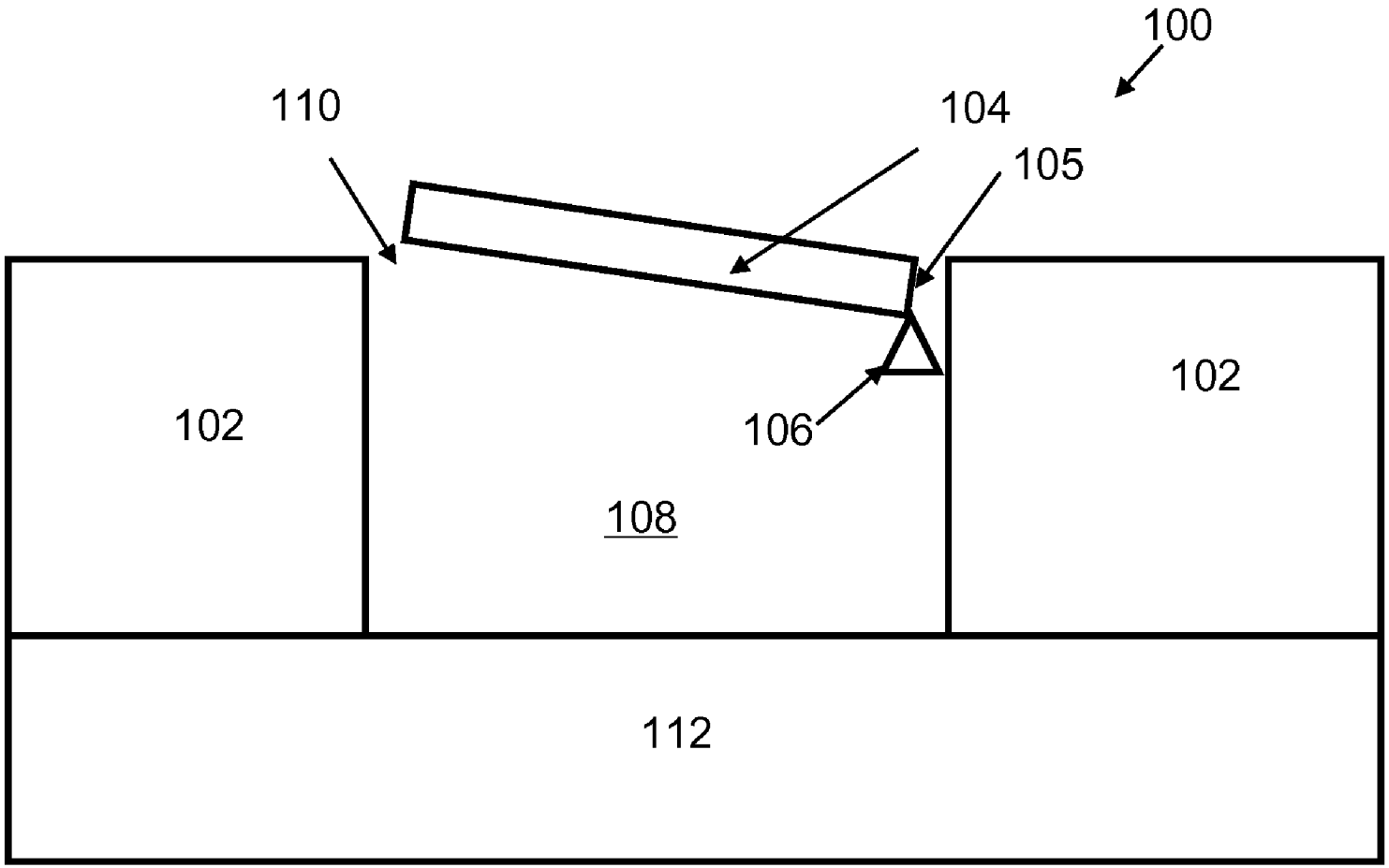
FIGS. 1A and 1B are side, cross-sectional and top schematic views, respectively, of an omni-directional microphone in accordance with the invention.
Figure 1B:
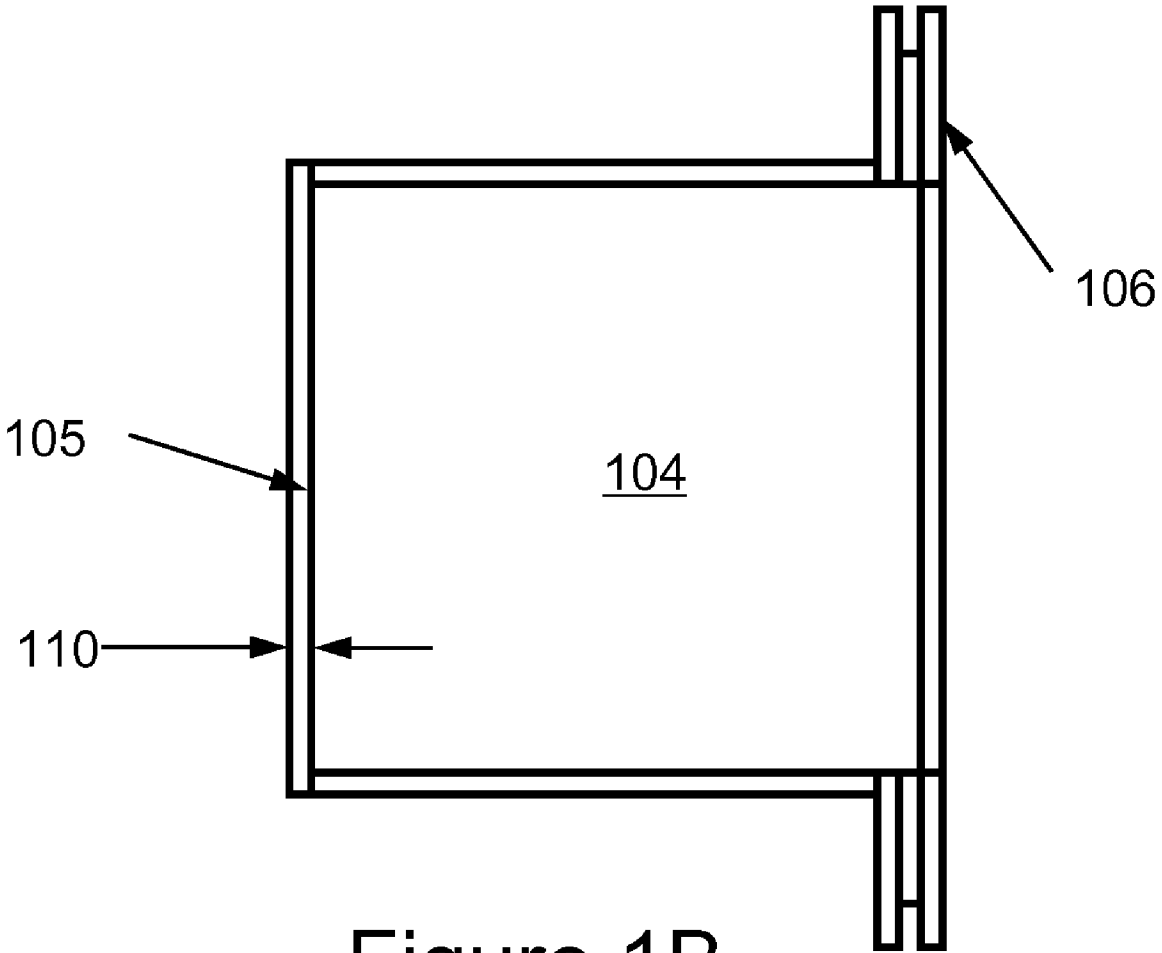

Referring first to FIGS. 1A and 1B, there are shown side, cross-sectional and top schematic views, respectively, of a microphone diaphragm in accordance with the present invention, generally at reference number 100. The inventive microphone 100 is typically formed in silicon using micromachining operations as are well known to those of skill in the art. It is noted that materials other than silicon may be used to form the diaphragm, and the techniques other than the silicon micromachining techniques may be employed, as appropriate or desired.

A silicon chip or wafer 102 has been processed (e.g., micromachined) to form a thin diaphragm 104 supported by a pivot 106. Diaphragm 104 is separated from silicon wafer 102 by a slit 110 disposed between the outer edge 105 of diaphragm 104 and silicon wafer 102. Slit 110 typically extends around substantially the entire perimeter 105 of diaphragm 104.

A back volume 108 is formed behind diaphragm 104 in silicon wafer 102. Typically, silicon wafer 102 is mounted on a substrate 112 that may seal a portion of back volume 108. The back volume 108 is defined, for example, by a recess in the substrate 112 which communicates with the slit 110, and provides sufficient depth to allow movement of the diaphragm 104 in response to acoustic waves.

By proper design of the flexible pivots 106 and the dimensions of the slit 110, the overall stiffness of the diaphragm 104 is determined by the dimensions of the volume of air behind the diaphragm 104 (i.e., back volume 108) rather than by the material properties or the dimensions of the pivots 106. The flexible pivots 106 are provided with sufficient compliance (e.g., the stress-strain relationship) such that they do not impose a dominant force on the diaphragm 104, with respect to slit 110 and the fluid or gas in the back volume 108, to substantially control the overall stiffness. Of course, there may be instances where a stiffness contribution from the flexible pivots 106 or other elements may be desired, for example to provide mechanical frequency response control, which may be implemented without departing from the spirit of the invention.

An approximate model for the mechanical sensitivity of a miniature microphone, for example the microphone of FIGS.

1A and 1B, has been developed. The diaphragm 104 of the miniature microphone is assumed to be supported in such a way that the structural connection (e.g., pivots 106) of the diaphragm 104 to the surrounding substrate 102 is extremely compliant. The effective stiffness of the diaphragm 104 is therefore primarily determined by the air volume 108 therebehind.

In order to achieve this high structural compliance, it is assumed that the diaphragm 104 is typically supported at only a small fraction of its perimeter, leaving a narrow gap of slit 110 around most of the perimeter 105. This approximate model includes the effects of the air in both the back volume 108 behind the diaphragm 104 and in narrow slit 110 around the diaphragm's perimeter 105. The air in the back volume 108 acts like a spring. Due to the narrowness of the slit 110, viscous forces control the flow of air therethrough. It has been found that the slit 110 and back volume 108 have a pronounced effect on the response of the diaphragm 104. The model shows that by proper design of the compliance of the diaphragm 104 and the dimensions of the surrounding slit 110, the mechanical response to incident sound, not shown, has good sensitivity over the audible frequency range, over a large range of sizes of diaphragm 104. This makes it feasible to produce microphones that are substantially smaller than those possible using currently available technology.

In analyzing the inventive technology, consider first, a conventional microphone diaphragm (i.e., a diaphragm having no surrounding slit) consisting of an impermeable plate or membrane that is supported around its entire perimeter. Assume that the pressure in the air behind the microphone diaphragm does not vary due to the incident sound. In this case, the diaphragm response may be modeled as a linear second order oscillator:

$$m\ddot{x}+kx+C\dot{x}=-PA \tag{1}$$

where m is the diaphragm mass, x is the displacement of the diaphragm, k is the effective mechanical stiffness, C is the viscous damping coefficient, and P is the pressure due to the applied sound field. Assume that a positive pressure at the diaphragm's exterior results in a force in the negative direction. If the resonant frequency, $\omega_0=\sqrt{k/m}$, is above the highest frequency of interest, then the mechanical sensitivity is $s_m \approx A/k$.

In the preferred microphone 100 according to the present invention, if the dimensions of the air chamber back volume 108 behind the diaphragm 104 are much smaller than the wavelength of sound, it may be assumed that the air pressure in the back volume 108 is independent of location. The air in this volume 108 will then act like a linear spring. The fluctuating pressure in the back volume 108 (V), due to a fluctuation in the volume, dV, resulting from the outward motion of the diaphragm 104, x, is:

$$P_d=\rho_0 c^2 dV/V=-\rho_0 c^2 Ax/V \tag{2}$$

where $\rho_0$ is the density of air and c is the sound speed. The negative sign results from the fact that an outward, or positive motion of the diaphragm 104 increases the volume of back volume 108 and thus reduces the internal pressure therein. This pressure in the back volume 108 exerts a force on the diaphragm given by:

$$F_d=P_d{}^*A=-\rho_0 c^2 A^2 x/V=-K_d x \tag{3}$$

where $$K_d=\rho_0 c^2 A^2/V \tag{4}$$

is the equivalent spring constant of the air in N/m.

The force due to the air in the back volume 108 adds to the restoring force due to the mechanical stiffness of the diaphragm 104. Including the air in the back volume 108, equation (1) becomes:

$$m\ddot{x}+kx+K_d x+C\dot{x}=-PA \tag{5}$$

so that the mechanical sensitivity now becomes $S_m \approx A/(k+K_d)$.

The effect of the air in the slit 110 must also be considered. The air in the slit 110 around diaphragm 104 is forced to move due to the fluctuating pressures both within the back volume 108 space behind the diaphragm 104 and in the external sound field. Again, assume that the dimensions of these volumes of moving air are much less than the wavelength of sound so that they can be represented by a single lumped mass, $m_a$. An outward displacement of the air in the slit 110, $x_a$, causes a change in volume of the air in the back volume 108 given by $-A_a x_a$ and a corresponding pressure given by:

$$P_{aa}=-\rho_0 c^2 A_a x_a/V \tag{6}$$

where $A_a$ is the area of the slit upon which the pressure acts.

The pressure due to the motion of the air in the slit 110 applies a restoring force on the mass of air in the slit 110 given by:

$$F_{aa}=-\rho_O c^2 A_a{}^2 x_d/V=-K_{aa}x_a \tag{7}$$

where $$K_{aa}=\rho_0 c^2 A_a{}^2/v. \tag{8}$$

The pressure due to the motion of the air in the slit 110 also exerts a force on the diaphragm 104 given by:

$$F_{da}=P_d A_a=-\rho_0 c^2 AA_a x/V=-K_{da}x \tag{9}$$

where $$K_{da}=\rho_0 c^2 AA_a/V \tag{10}$$

Likewise, the pressure due to the motion of the diaphragm 104 in equation (2) produces a force on the air in the slit 110 that is given by:

$$F_{da}=P_d A_a=-\rho_0 c^2 AA_a x/V=-K_{da}x \tag{11}$$

where $K_{da}=K_{ad}$ as given in equation (10).

Because the air in the slit 110 is squeezed through a relatively small opening, the effects which result in a velocity dependent restoring force on the air in the slit 110 must be accounted for, $$F_\upsilon=-c_\upsilon \dot{x}_a \tag{12}$$

where $c_\upsilon$ is a viscous damping coefficient that depends on the details of the airflow.

Finally, the externally applied force on the air in the slit 110 due to the incident sound field is:

$$F_a=-PA_a \tag{13}$$

Summing the forces on the moving elements of the system gives the following pair of governing equations:

$$m\ddot{x}+(k+K_d)x+K_{ad}x_a+C\dot{x}=-PA$$

$$m_a\ddot{x}_a+K_{aa}x_a+K_{da}x+c_\upsilon\dot{x}_a=-PA_a \tag{14}$$

Response due to harmonic sound fields may also be considered. If it is assumed that the sound pressure is harmonic with frequency ω then let $P(t)=Pe^{j\omega t}$, $x(t)=Xe^{j\omega t}$ and $x_a(t)=x_a e^{j\omega t}$. Equations (14) can be solved to give the steady-state response relative to the amplitude of the pressure. This is expressed as:

$$\begin{pmatrix} X/P \\ X_a/P \end{pmatrix} = \begin{bmatrix} k + K_d - \omega^2 m + \hat{\imath}\omega C & K_{ad} \\ K_{da} & K_{aa} - \omega^2 m_a + \hat{\imath}\omega c_\upsilon \end{bmatrix}^{-1} \begin{pmatrix} -A \\ -A_a \end{pmatrix} \tag{15}$$

The response of the microphone diaphragm 104 is then:

$$X/P = \frac{-A(K_{aa} - \omega^2 m_a + \hat{\imath}\omega c_\upsilon)}{(k + K_d - \omega^2 m + \hat{\imath}\omega C) * (K_{aa} - \omega^2 m_a + \hat{\imath}\omega c_\upsilon) - K_{ad} * K_{da}} \tag{16}$$

Note that equations (8) and (10) give $AK_{aa}=A_aK_{ad}$ so that equation (16) becomes:

$$X/P = \frac{-A(\omega^2 m_a + \hat{\imath}\omega c_\upsilon)}{(k + K_d - \omega^2 m + \hat{\imath}\omega C) * (K_{aa} - \omega^2 m_a + \hat{\imath}\omega c_\upsilon) - K_{ad} * K_{da}} \tag{17}$$

The ω dependence in the numerator of this expression of equation (17) clearly shows that the response has a high-pass filter characteristic. The cut-off frequency of the high-pass response is given by:

$$\omega_{cut} = \frac{K_{aa} k}{c_\upsilon (k + K_d)} \tag{18}$$

Note that for sufficiently large $c_\upsilon$, equation (17) becomes:

$$X/P \approx \frac{-A}{k + K_d - \omega^2 m + \hat{\imath}\omega C} \tag{19}$$

in which case the response behaves as if the enclosure is sealed with an equivalent stiffness $k+K_d$.

Another important special case occurs if the diaphragm's mechanical stiffness is significantly less than the stiffness of the air behind the diaphragm, $k \ll K_d$ in equation (17). In this case, equation (17) becomes:

$$\begin{aligned} X/P &= \frac{-A(\omega^2 m_a + \hat{\imath}\omega c_\upsilon)}{(K_d - \omega^2 m + \hat{\imath}\omega C) * (K_{aa} - \omega^2 m_a + \hat{\imath}\omega c_\upsilon) - K_{ad} * K_{da}} \\ &= \frac{-A(-\omega^2 m_a + \hat{\imath}\omega c_\upsilon)}{(-\omega^2 m + \hat{\imath}\omega C)(-\omega^2 m_a + \hat{\imath}\omega c_\upsilon) + K_{aa}(-\omega^2 m_a + \hat{\imath}\omega C) + K_d(-\omega^2 m_a + \hat{\imath}\omega c_\upsilon)} \end{aligned} \tag{20}$$

If attention is limited to the lower frequencies where terms that are proportional to $\omega^2$ may be neglected, equation (20) becomes:

$$X/P = -\frac{-A\hat{\imath}\omega c_\upsilon}{K_{aa}(\hat{\imath}\omega C) + K_d \hat{\imath}\omega c_\upsilon} = \frac{-Ac_\upsilon}{K_{aa}C + K_d c_\upsilon} \tag{21}$$

If the viscous damping in the system is dominated by the viscous damping of the air in the slit 110, $c_\upsilon \gg C$. If when this is true, by using equations (4) and (8), equation (21) becomes:

$$X/P = \frac{-Ac_\upsilon}{K_d c_\upsilon} \approx \frac{-A}{K_d} = \frac{-A}{(\rho_0 c^2 A^2/V)} = -\frac{V}{\rho_0 c^2 A} \tag{22}$$

In this case, the mechanical sensitivity of the microphone is no longer determined by the structural features of the diaphragm 104 or its material properties. The stiffness and resulting sensitivity are determined substantially by the properties of the air spring behind the diaphragm 104. Consequently, a very small microphone may be designed wherein diaphragm area A is made small while holding the size of the back volume 108 V constant. This produces the added benefit of increasing the microphone's sensitivity. Also, if the depth of back volume 108 is d, and the other back volume dimensions are equal to the length and width of the diaphragm 140, then V=dA. Equation (22) then becomes:

$$|X/P| = -\frac{d}{\rho_0 c^2} \tag{23}$$

For air $\rho_0 c^2 \approx 1.4\times10^5$. Sensitivity is independent of area A of the diaphragm 104 so that very small diaphragms may be effective. If the microphone is fabricated using silicon microfabrication techniques, as discussed herein below, and the depth of the back volume 108 is equal to the thickness of the wafer 102, then a typical depth is d=500 μm. The magnitude of the mechanical sensitivity is then $|X/P| \approx 3.5$ nm/Pascal.

Note that this sensitivity is achieved when the diaphragm's mechanical stiffness is much less than that of the air spring so that $k \ll K_d$.

Figure 2:
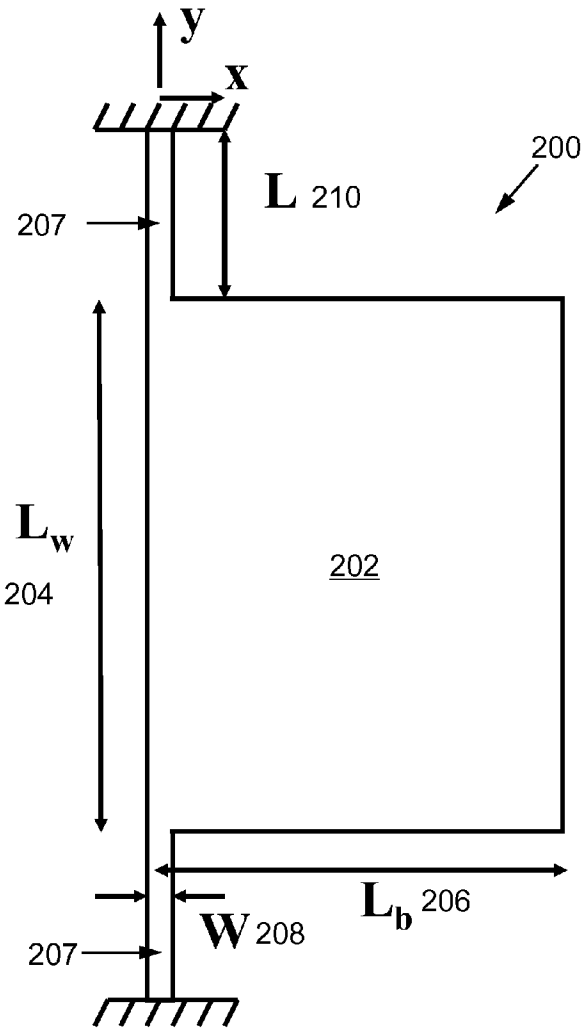
FIG. 2 is a schematic, plan view of a miniature microphone diaphragm.

Referring now to FIG. 2, there is shown a schematic, plan view of a miniature microphone diaphragm, generally at reference number 200. Assume that diaphragm 200 is fabricated out of a film of polycrystalline silicon having a thickness, h. The main part of the diaphragm 200 is a rectangular plate 202 having a first dimension $L_w$, 204, and a second dimension $L_b$ 206. The diaphragm 200 is supported only at the ends of the rectangular support beams 207, each having dimensions W 208 by L 210. While a more detailed analysis might be useful in identifying details of the design, the following analysis identifies the dominant parameters in the design and gives an estimate of the feasibility of constructing a diaphragm 200 that is sufficiently flexible so that equation (22) is valid.

In this approximate model, assume that the rectangular diaphragm rotates like a rigid body about the y axis 212. The two support beams 206 behave like linear restoring torsional springs having a total torsional stiffness that may be estimated by:

$$k_t \approx \frac{2\beta G W h^3}{L} \tag{24}$$

where $\beta \approx 1/3$ and G is the shear modulus of the material.

Assuming that the polysilicon layer is linearly isotropic, the shear modulus may be calculated from $$G = \frac{E}{2(1+\gamma)},$$

where E is Young's modulus of elasticity ($E \approx 170 \times 10^9 N/m^2$ for polysilicon) and $\gamma$ is Poisson's ratio ($\gamma \approx 0.3$).

Assuming that the diaphragm is thin so that h is much smaller than $L_w$ 204 and $L_b$ 206, the mass moment of inertia of the diaphragm 200 about the y axis may be approximated by:

$$I_{yy} = \frac{L_w h \rho l_b^3}{3} \tag{25}$$

where $\rho$ is the volume density of the material. For polysilicon, $\rho \approx 2300\ kg/m^3$.

The response of the diaphragm 200 due to an incident sound pressure P in terms of rotation $\theta$, about the pivot (i.e., the y-axis) may be written as:

$$I_{yy}\ddot{\theta} + k_t\theta = PAL_b/2 \tag{26}$$

where $A = L_w L_b$ is the area of the diaphragm 200 that is acted on by the sound pressure P, and $L_b/2$ is the distance between the center of the diaphragm 200 and the pivot. In order to convert the rotational representation of equation (26) into one that uses the displacement x as the generalized coordinate, as in equation (5), note that $x = \theta L_b/2$ or $\theta = 2x/L_b$. Replacing $\theta$ with x allows equation (26) to be rewritten as:

$$I_{yy} 2\ddot{x}/L_b + k_t 2x/L_b = PAL_b/2 \tag{27}$$

or $$I_{yy}\left(\frac{2}{L_b}\right)^2 \ddot{x} + k_t\left(\frac{2}{L_b}\right)^2 x = PA \tag{28}$$

Comparing equations (5) and (28) gives the equivalent mass as:

$$m = I_{yy}\left(\frac{2}{L_b}\right)^2 \tag{29}$$

Similarly, the equivalent stiffness is:

$$k = k_t\left(\frac{2}{L_b}\right)^2 \tag{30}$$

Equations (24) and (30) allow the mechanical stiffness of the diaphragm supports to be estimated, which may then be compared to the stiffness of the air in the back volume, $K_d$. For a design in which L=100 μm, $L_w$=250 μm, $L_b$=250 μm, W=5 μm, h=1 μm, d=500 μm, the equivalent stiffness of the diaphragm from equations (24) and (30) is k≈0.14N/m while the effective stiffness of the air in the back volume 108 is $K_d$=17.5N/m. The mechanical stiffness of this design, k, is clearly negligible compared to the stiffness of the air spring, $K_d$. In general, the permissible ratio of $K_d/k$ is dependent on the environment of use and the associated requirements, but for most applications, a ratio of 20-1,000 will be preferred. For example, it is preferred that the structural stiffness of the support k be less than 10% of the effective stiffness defined by the air spring $K_d$, and more preferably less than 5%, and most preferably less than 1%. The microphone may have a usable range over the audio band, 20 Hz to 20 kHz, though there is no particular limit on the invention imposed by the limits of human hearing, and the frequency response may therefore extend, for example, from 1 Hz to ultrasonic frequencies, e.g., 25 kHz and above, in accordance with the design parameters set forth above, for technical applications. In a typical consumer electronic device, a preferred acoustic bandwidth (±3 dB) is about 40 Hz-3.2 kHz, more preferably about 30 Hz to 8 kHz. In many cases, the transducer and associated electronics will limit the effective response of the sensor, rather than the diaphragm intrinsic response, and indeed band-limiting may be a design feature of the transducer.

Based on the foregoing, preliminary estimate, the assumptions behind equations (22) and (23) are not difficult to realize. The magnitude of the mechanical sensitivity may then be estimated from equation (23) to be |X/P|≈3.5 nm/Pascal.

Figure 5:
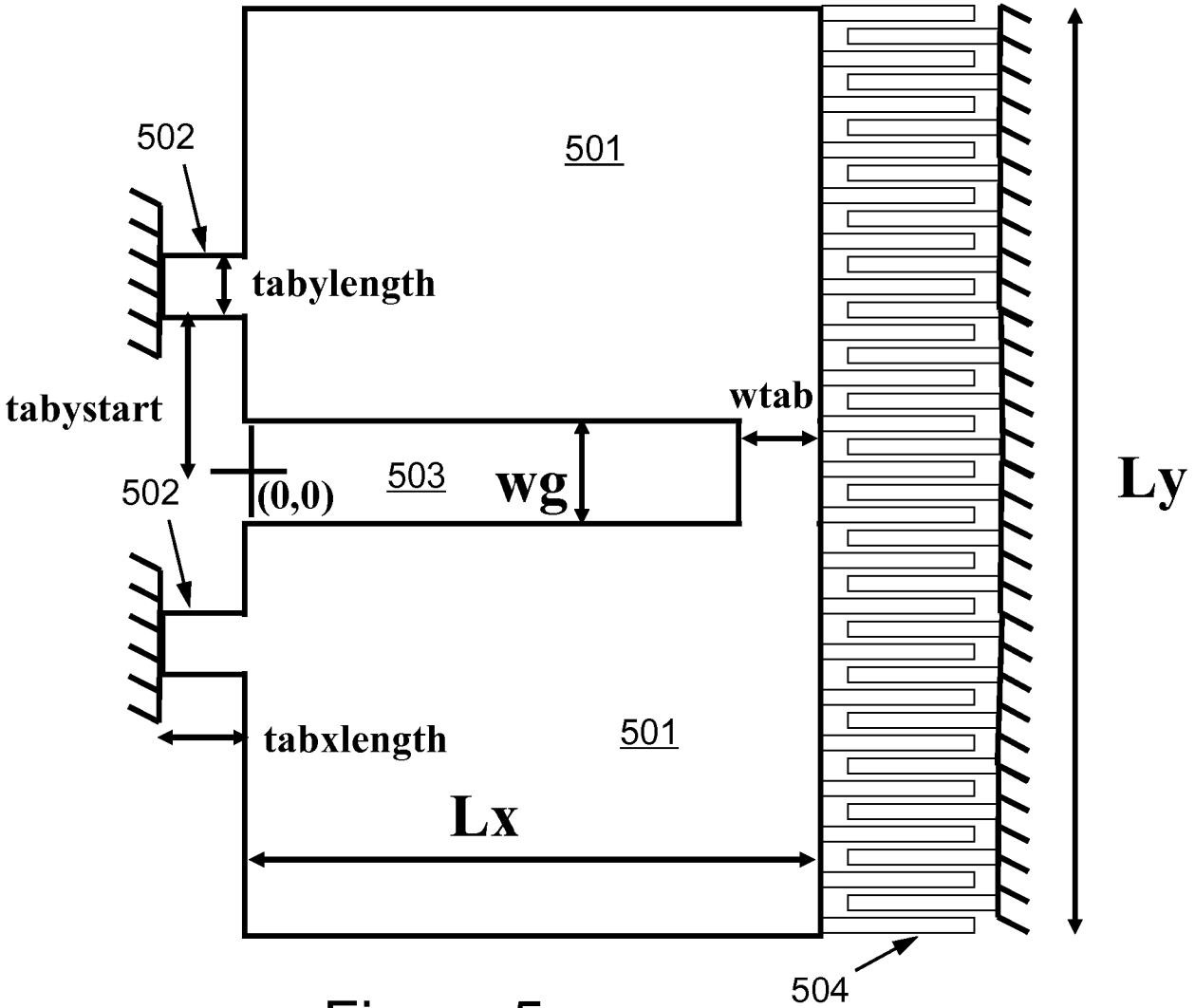
FIG. 5 is a plan view of a microphone having a tab support system and interdigitated comb sense fingers.

It is also possible to mount the diaphragm 501 for linear movement instead of rotational movement, by providing a set of tabs 502 spaced about its periphery as shown in FIG. 5. Likewise, a cantilever support will allow rotational movement of the diaphragm with a different placement of supporting structures than the torsional bars. The diaphragm 501 shown in FIG. 5 also includes an optional slit 503 of width wg. This may be included to greatly reduce the effect of intrinsic stress on the tabs 502 that support the diaphragm 501. The Diaphragm 501 displacement may be sensed, for example, by a set of interdigital finger electrodes 504.

The supporting structures for the diaphragm 200 are not limited to having a length equal to the width of the slit 110, but rather may themselves have adjacent or underlying reliefs to provide supports of sufficient length to achieve a desired stiffness.

Therefore, while a preferred embodiment comprises hinges disposed at one edge of the diaphragm, it is also possible to provide alternate supporting structures which do not substantially contribute to the effective stiffness of the diaphragm.

Referring now to FIGS. 3A-3E, a practical microphone as described hereinabove may be fabricated using silicon microfabrication techniques. The fabrication process begins with a bare silicon wafer 300, FIG. 3A.

Figures 3A, 3B, 3C, 3D, 3E:
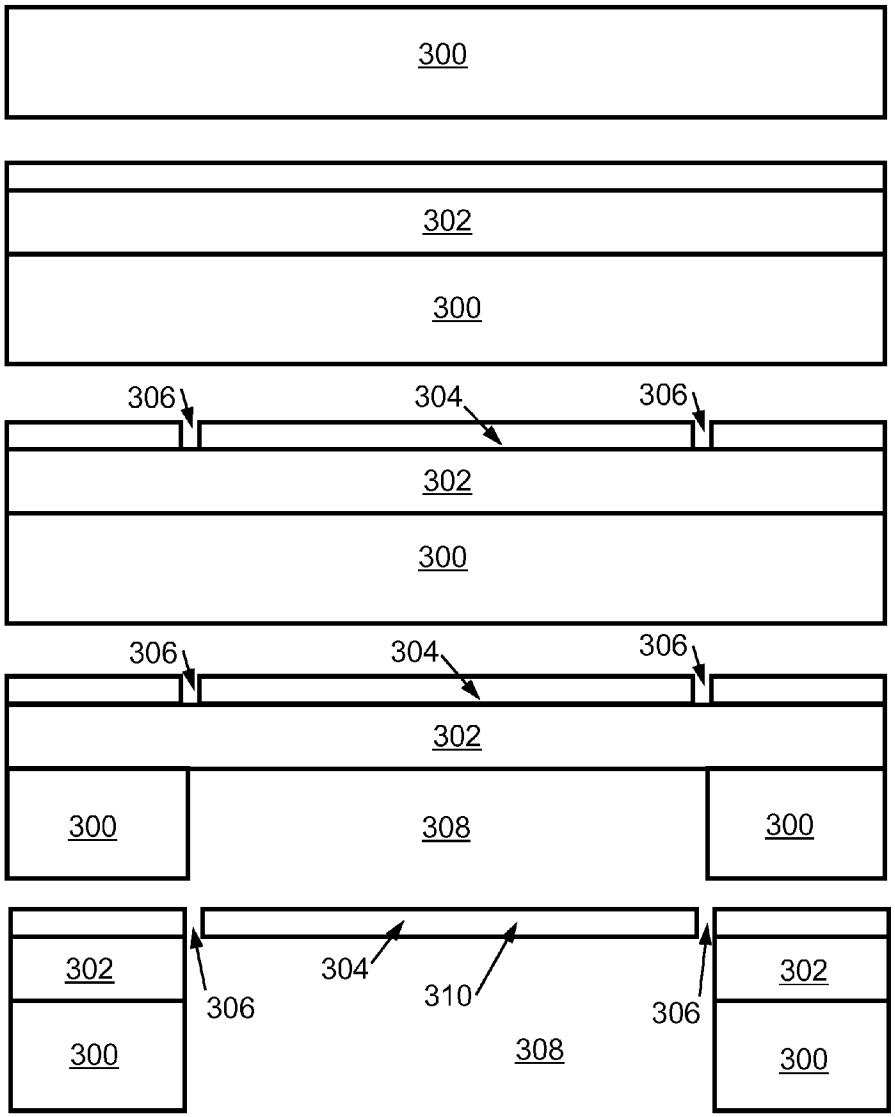
FIGS. 3A-3E are schematic representations of the fabrication process steps of the microphone diaphragm of FIGS. 1A, 1B, and 2.

A sacrificial layer 302 is deposited or formed on an upper surface of silicon wafer 300 as may be seen in FIG. 3B. Sacrificial layer 302 is typically silicon dioxide, but, other materials that may be readily removed may be used. Such materials are known to those of skill in the silicon microfabrication arts and are not further discussed herein. A layer 304 of structural material such as polysilicon is deposited over sacrificial layer 302. Layer 304 ultimately forms the microphone diaphragm 104 (FIGS. 1A, 1B). It is also possible to obtain a similar construction where the diaphragm material is made of stress-free single crystal silicon by using a silicon-on-insulator (SOI) wafer.

As may be seen in FIG. 3C, the diaphragm material (i.e., structural layer 304) is next patterned and etched to create slits 306 that isolate the diaphragm 310 from the remainder of structural layer 304.

As may be seen in FIG. 3D, a backside through-wafer etch is next performed to create the back volume of air behind the diaphragm 310.

Finally, as may be seen in FIG. 3E, sacrificial layer 302 is removed to separate diaphragm 310 from the remainder of the structure.

The motion of diaphragm 310 may be converted into an electronic signal in many ways. For example, comb sense fingers, not shown, may be disposed on the perimeter of diaphragm 310. Comb sense fingers are described in detail in U.S. patent application Ser. No. 11/198,370 for COMB SENSE MICROPHONE, filed Aug. 5, 2005, expressly incorporated herein by reference. Advantageously, the sensing elements for the diaphragm 310 movement are formed using the silicon wafer 300 and/or structural layer 304 as supports for conducting materials, and/or these may be processed by standard semiconductor processing techniques for form functional doped and/or insulating regions, and/or integrated electronic devices may be formed therein. For example, a transducer excitation circuit and/or amplifier may be integrated into the silicon wafer 300, to directly provide a buffered output.

Figure 4:
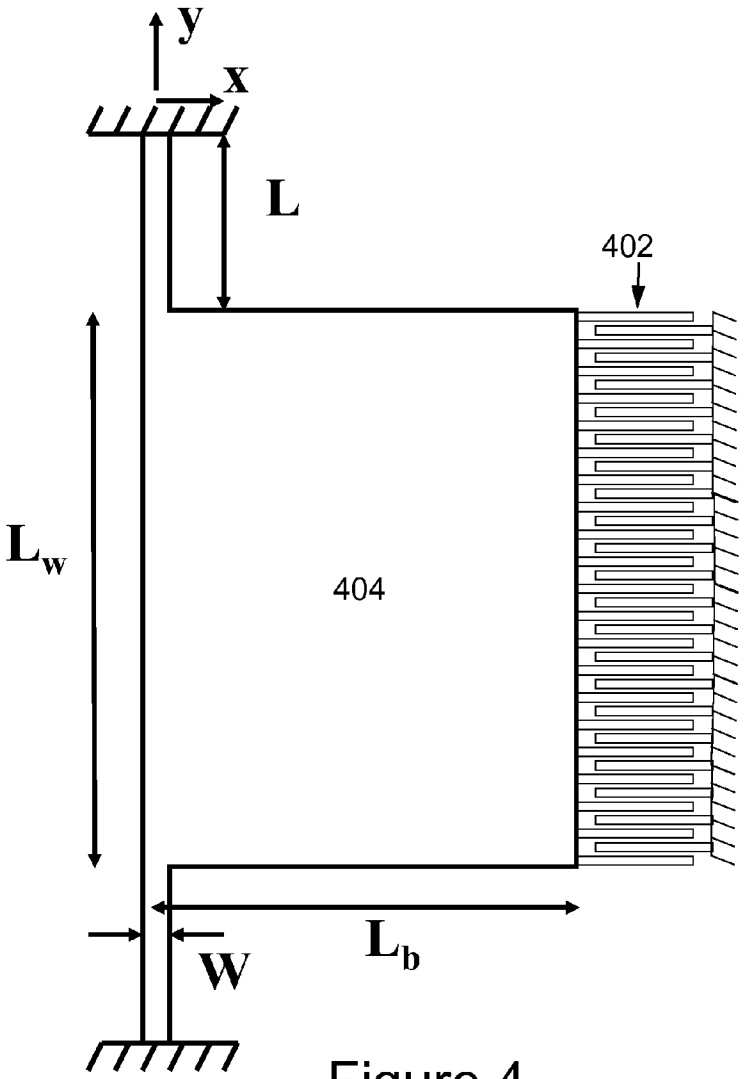
FIG. 4 is a plan view of the microphone of FIGS. 1A and 1B having interdigitated comb sense fingers.

FIG. 4 shows a possible arrangement wherein interdigitated comb sense fingers 402 are incorporated in the microphone diaphragm 404. A bias voltage or modulated voltage waveform may be applied to the microphone diaphragm 404 through the interdigitated comb sense fingers 402 to utilize capacitive sensing as the means to develop an output voltage. Because the electrostatic forces between the comb sense fingers on the diaphragm and the corresponding fingers on the substrate has a substantial component coplanar with the diaphragm, the effect on diaphragm stiffness is attenuated. Likewise, the force component normal to the surface does not tend to displace the diaphragm far from the home position, though during operation, the respective comb sense fingers should be displaced from each other to avoid signal nulls. The displaced position of the comb fingers can be imposed by the stress gradient through the thickness of the fingers. It is well known that stress gradients cause out of plane displacements in flexible structures. Another method of imposing a controllable out of plane displacement, or offset of the comb fingers, is to apply a bias voltage between the wafer substrate material and the diaphragm fingers. This will cause the diaphragm to deflect relative to the fingers that are firmly attached to the surrounding substrate.

In alternate embodiments, optical sensing may be used to convert diaphragm motion into an electrical signal. Optical sensing is described in U.S. patent application Ser. No. 11/335,137 for OPTICAL SENSING IN A DIRECTIONAL MEMS MICROPHONE, filed Jan. 19, 2006, expressly incorporated herein by reference.

It will be recognized by those of skill in the art that numerous other methods may be utilized to generate an electrical signal representative of the motion of the diaphragm into an electrical signal. Consequently, the invention is not limited to the methods chosen for purposes of disclosure. Rather, the invention covers any and all methods for generating an output signal representing sounds or acoustic vibrations which act upon the diaphragm.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

What is claimed is:

1. A microphone, comprising:

a) a stiff diaphragm;

b) a resilient support for the diaphragm, the resilient support being configured to permit the diaphragm to freely respond to acoustic waves by displacement thereof;

c) a housing defining, with the diaphragm, a region having a volume comprising at least a space behind the diaphragm, wherein a displacement of the diaphragm changes a volume of the region;

d) at least one port, communicating between the region and an environment, wherein a responsivity of the diaphragm to displacement by acoustic waves in an audio frequency acoustic range is principally defined by a volume of the region and a configuration of the at least one port, and a responsivity of the diaphragm to displacement by acoustic waves in an audio frequency acoustic range is not principally defined by a stiffness of the resilient support.

2. The microphone according to claim 1, wherein the housing comprises a perforated substrate and a cover, the diaphragm, perforated substrate and cover substantially enclosing the region.

3. The microphone according to claim 1, wherein the diaphragm comprises a micromachined silicon membrane.

4. The microphone according to claim 1, wherein the port comprises a gap disposed between at least a portion of a perimeter of the diaphragm and a wall of the housing.

5. The microphone according to claim 1, wherein the port conducts a viscous flow of fluid therethrough in response to acoustic vibration induced displacement of the diaphragm.

6. The microphone according to claim 1, whereby a sensitivity of the microphone at an audio frequency is principally determined by a volume of air within the region.

7. The microphone according to claim 1, wherein the resilient support comprises at least one torsional support for displaceably supporting the diaphragm adjacent to the region.

8. The microphone according to claim 1, wherein the resilient support comprises at least one flexural support for displaceably supporting the diaphragm adjacent to the volume region.

9. The microphone according to claim 1, wherein the diaphragm deflects about a rotational axis in response to acoustic waves.

10. The microphone according to claim 1, further comprising a transducer configured to convert a displacement of the diaphragm in response to acoustic waves into an electrical signal representing the acoustic waves.

11. The microphone according to claim 1, further comprising an interdigital transducer configured to detect a displacement of the diaphragm in response to the acoustic waves.

12. The microphone according to claim 1, further comprising an optical transducer configured to detect a displacement of the diaphragm.

13. The microphone according to claim 1, wherein the diaphragm responds to acoustic waves in the audio frequency acoustic range by a displacement approximated by a linear second order oscillator model:

$$m\ddot{x}+kx+C\dot{x}=-PA \quad (1)$$

where m is a mass of the diaphragm, x is a displacement of the diaphragm, k is an effective mechanical stiffness of the diaphragm, C is a viscous damping coefficient of a fluid flowing through the port, and P is a pressure incident on the diaphragm due to an applied sound field o the acoustic waves, wherein k is defined principally by a volume of air in the region.

14. The microphone according to claim 1, formed by a process comprising providing a substrate;

depositing a sacrificial layer on an upper surface of the substrate;

depositing a layer of structural material on an upper surface of the sacrificial layer to form a diaphragm layer;

creating at least one gap in the layer of structural material to isolate a microphone diaphragm region from peripheral region while preserving a resilient support region;

creating the region in the substrate behind the microphone diaphragm region; and removing a portion of the sacrificial layer, wherein the diaphragm comprises the microphone diaphragm region and the resilient support comprises the resilient support region.

15. The microphone according to claim 14, wherein the substrate comprises a silicon wafer.

16. The microphone according to claim 14, wherein the at least one gap is created by an etching process.

17. The microphone according to claim 14, wherein the structural material comprises polysilicon.

18. The microphone according to claim 14, wherein the void is created by performing a backside etch on the structural wafer.

19. A microphone, comprising:

(a) a diaphragm;

(b) a housing defining, with the diaphragm, a region behind the diaphragm having a volume, wherein a displacement of the diaphragm changes the volume of the region (c) at least one fluidic port, communicating between the region behind the diaphragm and an environment proximate and external to the region behind the diaphragm; and (d) a resilient support configured to mechanically support the diaphragm with respect to the housing, and to respond to acoustic waves by displacement of the diaphragm proportionally to an amplitude of the acoustic waves, the response being principally defined by a volume of the region and a configuration of the at least one fluidic port, and not principally defined by a stiffness of the resilient support.

20. The microphone according to claim 19, wherein a movement of the diaphragm in response to the acoustic waves is at least 3.5 nm/Pascal, with a ±3 dB response over an acoustic frequency range of at least 40 Hz to 3.2 kHz.

* * * * *